US005969314A

United States Patent [19]

Rakus et al.

[11] Patent Number: 5,969,314

[45] Date of Patent: Oct. 19, 1999

[54] ELECTRICAL SWITCHING APPARATUS HAVING ARC RUNNER INTEGRAL WITH STATIONARY ARCING CONTACT

[75] Inventors: Paul Richard Rakus, Hopewell Township; Glen Charles Sisson, Center Township; William J. Jones, Cranberry Township, all of Pa.

[73] Assignee: Eaton Corporation, Cleveland, Ohio

[21] Appl. No.: 09/074,234

[22] Filed: May 7, 1998

[51] Int. Cl.[6] ..... H01H 33/14; H01H 9/40

[52] U.S. Cl. ..... 218/7; 218/156; 218/14; 218/22

[58] Field of Search ..... 361/481; 335/201, 335/16, 147, 195; 218/7, 14–22, 29, 30, 34, 36, 40, 156, 148, 149

[56] References Cited

U.S. PATENT DOCUMENTS

| | | | |
|---|---|---|---|
| 2,471,608 | 5/1949 | Caswell | 335/16 |
| 3,238,339 | 3/1966 | Fehling | 335/147 |
| 3,662,134 | 5/1972 | Cellerini | 200/146 R |
| 4,229,630 | 10/1980 | Wafer et al. . | |
| 4,713,504 | 12/1987 | Maier | 200/146 R |
| 4,871,889 | 10/1989 | Leone et al. . | |
| 5,057,806 | 10/1991 | McKee et al. . | |
| 5,210,385 | 5/1993 | Morel et al. . | |

*Primary Examiner*—Lincoln Donovan
*Attorney, Agent, or Firm*—Martin J. Moran

[57] ABSTRACT

An integral stationary arcing contact and arc runner for electrical switching apparatus is formed by an electrically conductive member secured to the line conductor adjacent the stationary main contact thereby providing a joint free path for the arc to pass from the arcing contact to the arc runner. Preferably, the electrically conductive member is a sheet metal member having a base section secured to the line conductor, an arcing contact section adjacent the stationary main contact and extending generally perpendicular to the line conductor and a runner section extending at an obtuse angle to the arcing contact section toward the arc chute. A support member between the arcing contact section and the housing transmits reaction forces imposed by the moving conductor assembly on the sheet metal member into the housing.

13 Claims, 4 Drawing Sheets

ELECTRICAL SWITCHING APPARATUS HAVING ARC RUNNER INTEGRAL WITH STATIONARY ARCING CONTACT

The Government has rights in this invention under Government Contract Number N61331-94-C-0078

CROSS REFERENCES TO RELATED APPLICATIONS

This application is related to commonly owned, concurrently filed Patent Applications:

- Ser. No. 09/074,135, "ELECTRICAL SWITCHING APPARATUS WITH CONTACT FINGER GUIDE";
- Ser. No. 09/074,046, "ELECTRICAL SWITCHING APPARATUS WITH OPERATING CONDITION INDICATORS MOUNTED IN FACE PLATE";
- Ser. No. 09/074,075, "ELECTRICAL SWITCHING APPARATUS WITH IMPROVED CONTACT ARM CARRIER ARRANGEMENT";
- Ser. No. 09/074,073, "CHARGING MECHANISM FOR SPRING POWERED ELECTRICAL SWITCHING APPARATUS";
- Ser. No. 09/074,240, "ELECTRICAL SWITCHING APPARATUS WITH MODULAR OPERATING MECHANISM FOR MOUNTING AND CONTROLLING LARGE COMPRESSION CLOSE SPRING";
- Ser. No. 09/074,233, "ELECTRICAL SWITCHING APPARATUS WITH PUSH BUTTONS FOR A MODULAR OPERATING MECHANISM ACCESSIBLE THROUGH A COVER PLATE";
- Ser. No. 09/074,104, "INTERLOCK FOR ELECTRICAL SWITCHING APPARATUS WITH STORED ENERGY CLOSING";
- Ser. No. 09/074,133, "CLOSE PROP AND LATCH ASSEMBLY FOR STORED ENERGY OPERATING MECHANISM OF ELECTRICAL SWITCHING APPARATUS";
- Ser. No. 09/074,076, "SNAP ACTING CHARGE/DISCHARGE INDICATOR DISPLAYING CHARGE STATE OF CLOSE SPRING ON ELECTRICAL SWITCHING APPARATUS";and
- Ser. No. 09/074,052, "DISENGAGEABLE CHARGING MECHANISM FOR SPRING POWERED ELECTRICAL SWITCHING APPARATUS"

BACKGROUND OF THE INVENTION

1. Field of the Invention

This invention relates to electrical switching apparatus having arcing contacts which open after the main contacts to protect the main contacts from damage and wear caused by arcing. More particularly, it relates to the construction of the arc runner which transfers the arc from the arcing contacts to an arc chute where it is extinguished.

2. Background Information

Electrical switching apparatus for power distribution systems includes devices such as, for instance, circuit breakers, network protectors, transfer switches and disconnect switches. Power circuit breakers are typically used to connect a power distribution network to a power source. Such power circuit breakers must be able to withstand high currents for a period of time without tripping to give circuit breakers in the network time to respond and isolate the fault thereby localizing disruption of service. Thus, by the time the power circuit breaker responds, it may have to interrupt a sizable current. This results in the drawing of an arc as the circuit breaker contacts open. It is known to provide an arc chute adjacent to the opening path of the circuit breaker contacts. The arc chute is constructed of a number of spaced plates extending transverse to the arc. As the contacts open, the arc is transferred by electromagnetic forces to the arc plates which cool the arc and increase the arc voltage by breaking it up into sections, both of which help to extinguish the arc.

In a power circuit breaker with "heel-toe" contact parting action, the arcing end of a copper contact finger ("toe") comes in contact with a stationary copper arcing contact ("toe block") after the breaker has begun to open. The main contacts then part followed by parting of the arcing contacts resulting in the striking of an arc between the copper arcing contacts. This protects the main contacts from damage due to arcing. Typically, an arc runner is mounted on top of the stationary arcing contact in order to provide a surface for the arc to run toward the arc chute. The arc is formed on the arcing contact and must travel across the joint to the arc runner. At low currents, the electromagnetic force on the arc may not be adequate to force the arc to cross this joint. One end of the arc may remain on the stationary arcing contact, severely eroding the contact. If the arc does not move onto the arc runner it will not reach the arc chute in time for the breaker to interrupt.

Also, when the arc is created on the arcing contact, it is more likely to travel along a sharp edge or corner of the part. Arc runners often have a slot up the center of the part to provide an attractive edge for the arc to run along. The edge of the slot encourages the arc to travel up the center of the arc runner, engaging the arc chute near the center and extinguishing the arc sooner. At lower current levels, the arc may be attracted to the laterally extending edge of the stationary arcing contact instead of the slot in the arc runner. This may prevent the arc from running up the arc runner or cause the arc to run to one side of the pole where it may track along the inside wall of the arc chamber.

There is a need therefore for electrical switching apparatus with an improved arrangement for extinguishing arcs generated during current interruption.

There is a more specific need for such an improved arrangement for directing the arc from the stationary arcing contact into an arc chute.

SUMMARY OF THE INVENTION

These needs and others are satisfied by the invention which is directed to electrical switching apparatus in which the stationary arcing contact and the arc runner are integral thereby eliminating the joint between these two elements. This provides a single smooth surface from the point of arc creation to the top of the arc runner. The result is an increase in the speed of movement of the arc up the arc runner and into the arc chute, even at low current levels. Also, there is no top edge on the arcing contact which might lead the arc to one side of the arc chute. Furthermore, the integral arc runner can require fewer parts and may be easier to manufacture than the standard design.

More particularly, the integral arcing contact and arc runner comprises an electrically conductive member having a base surface in electrical contact with the line conductor of the electrical switching apparatus, an arcing contact surface which is adjacent to the stationary main contact carried by the line conductor, and a runner surface extending toward the arc chute. The arcing contact surface is substantially perpendicular to the base surface and at an obtuse angle to the runner surface. An arcuate surface provided between the arcing contact surface and the runner surface eliminates any sharp edges between the surfaces which could laterally divert the arc.

Preferably, the electrically conductive member is a sheet metal member such as copper or plated steel having a base section forming the base surface, an arcing contact section with the arcing contact surface and a runner section providing the runner surface. An arcuate section between the arcing contact section and the runner section forms the arcuate surface. A support member is provided between the arcing contact section and the housing to mechanically support and transmit the reaction forces on the stationary arcing contact section during opening and closing of the circuit breaker. The support member can be integrally formed with the housing or can be a separate member which is secured to the line conductor together with the sheet metal member by a common fastener.

The invention is particularly suitable for electrical switching apparatus having "heel-toe" contact parting action wherein the "toe" is a section of a contact finger which forms the movable arcing contact. The stationary arcing contact section of the sheet metal member forms the toe block.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention is applicable to electrical switching apparatus such as, for example, circuit breakers, network protectors, transfer switches and disconnect switches, and will be described as applied to a power circuit breaker.

Figure 1:
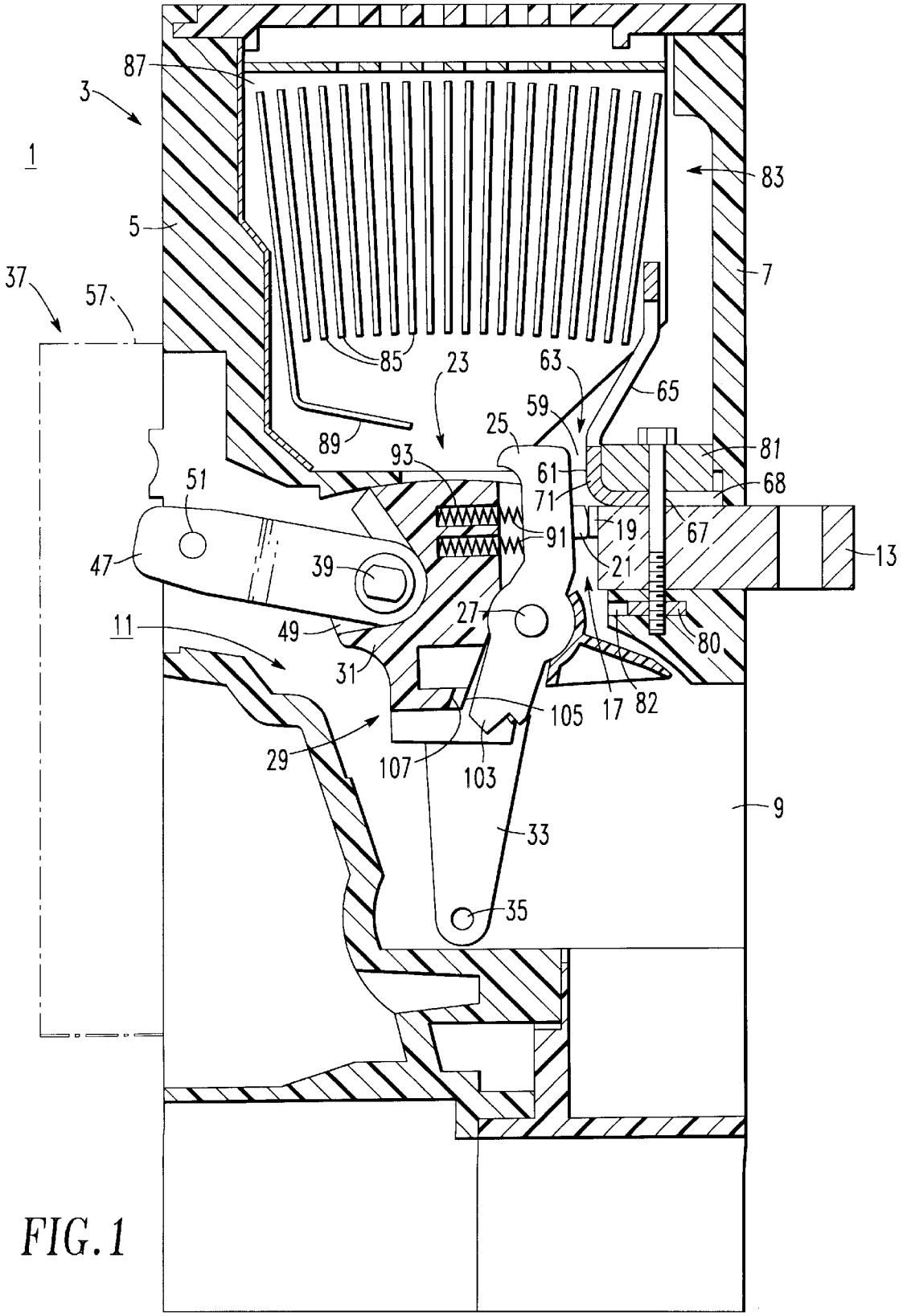
FIG. 1 is a vertical section through a circuit breaker incorporating the integral arcing contact and runner of the invention shown in the fully closed position.
Figure 2:
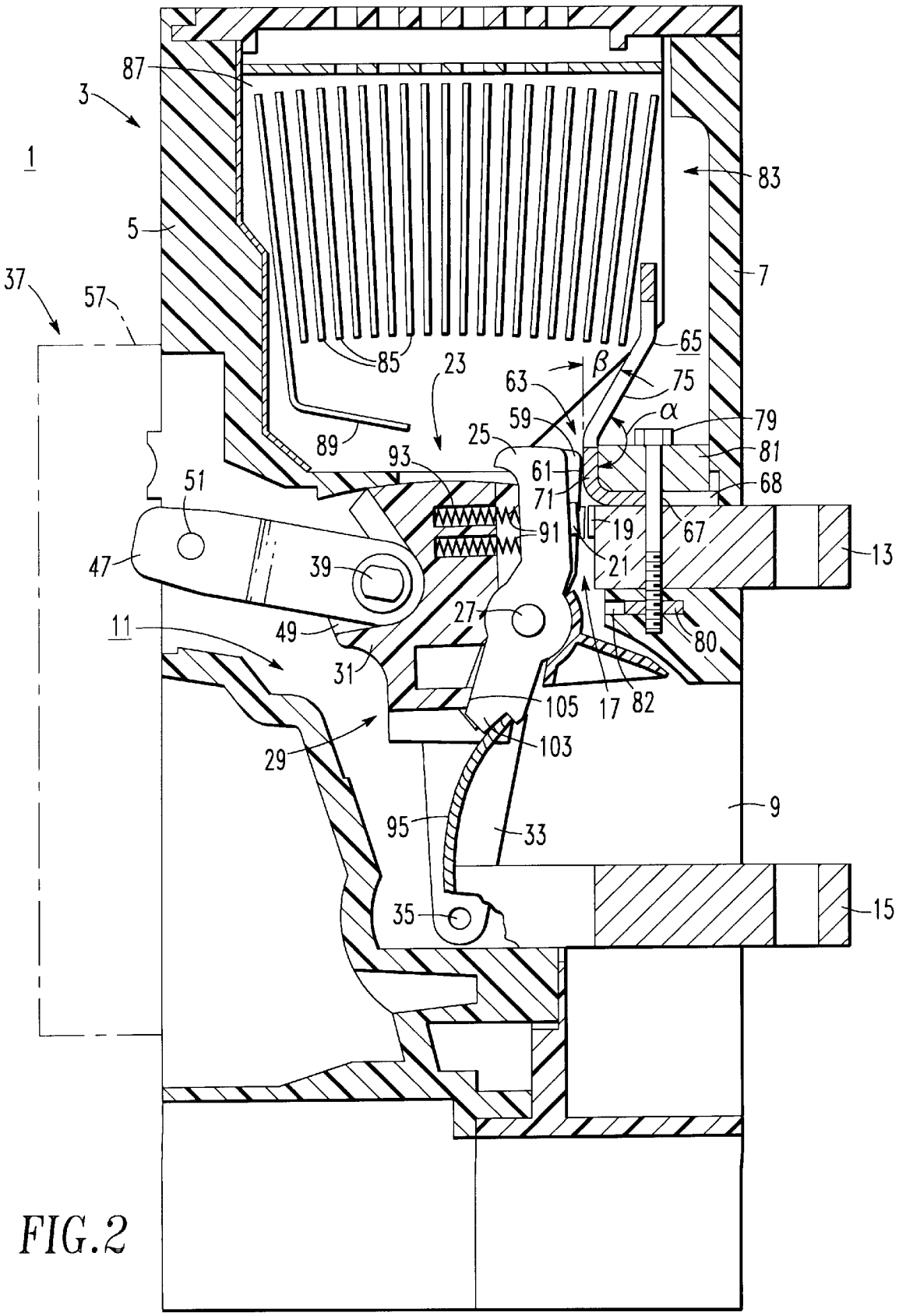
FIG. 2 is similar to FIG. 1 but showing the contact fingers about to break contact at the arcing toe.
Figure 3:
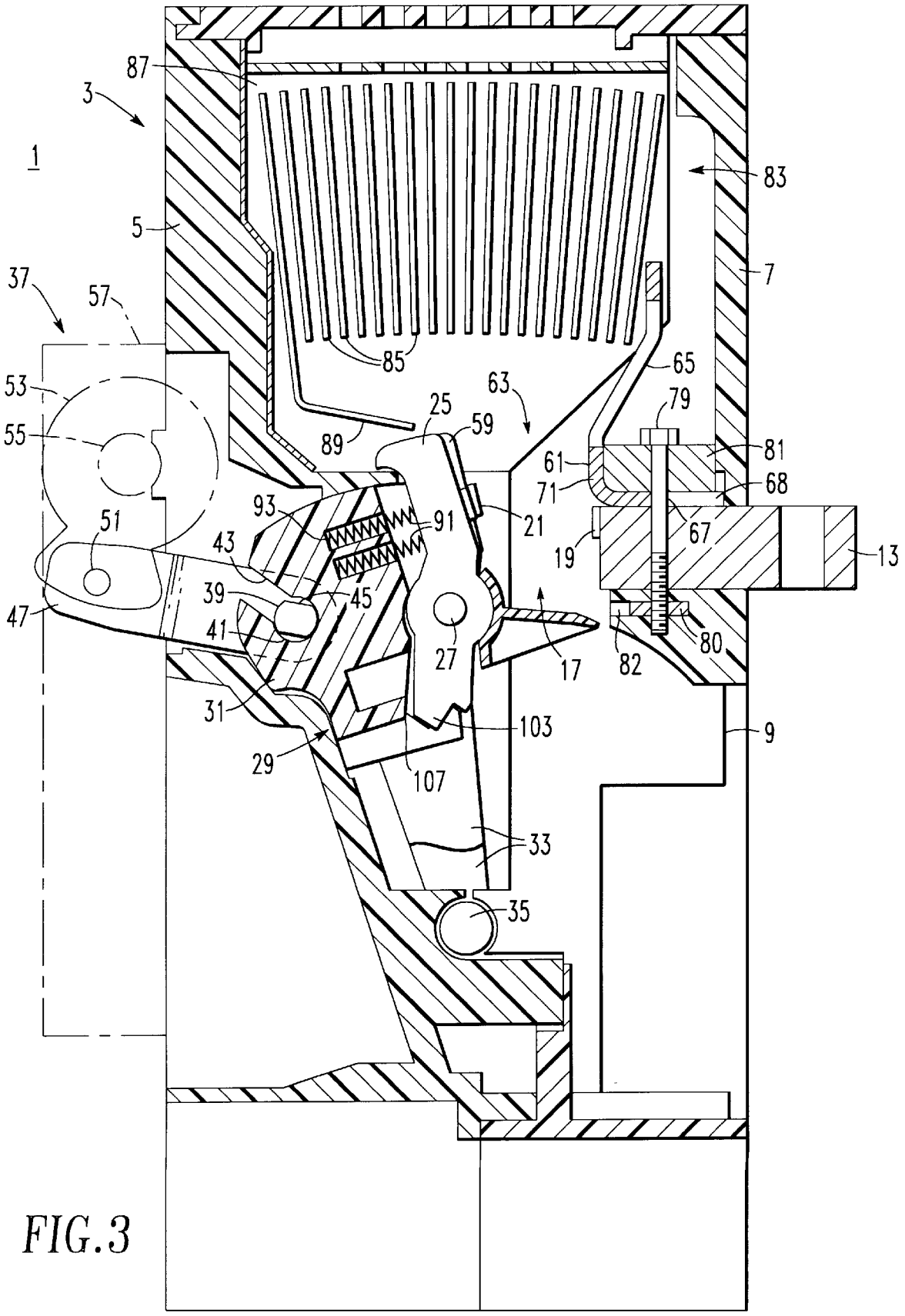
FIG. 3 is similar to FIG. 1 but showing the contact carrier in the fully open position.

FIGS. 1–3 illustrate a power air circuit breaker 1 having a housing 3 which includes a molded front casing 5 and rear casing 7 which together define pole chambers 9 each containing a pole device 11. Typically, the circuit breaker 1 has three poles, one for each phase in a three-phase system. FIGS. 1–3 are vertical sections through one of the pole chambers 9 taken along slightly different lines to show the pertinent features.

Each pole includes a line side conductor 13 which projects out of the rear casing 7 for connection to a source of ac electric power (not shown). A load conductor 15 also projects out of the rear casing 7 (see FIG. 1) for connection typically to the conductors of a load network (also not shown).

Each pole device 11 has a pair of main contacts 17 which include a stationary main contact 19 and movable main contact 21. The movable main contact 21 is carried by a moving conductor assembly 23. This movable conductor assembly 23 includes a plurality of contact fingers 25 which are mounted in spaced axial relation on a pivot pin 27 secured in a contact carrier 29. The contact carrier 29 has a molded body 31 and a pair of legs 33 (only one shown) having pivots 35 rotatably supported in the housing 3 (FIG. 3).

As best seen in FIG. 3, the contact carrier is rotated about the pivots 35 by a drive linkage 37 which includes a drive pin 39 which is received in a transverse passage 41 in the carrier body 31 through a slot 43 to which the drive pin 39 is keyed by flats 45. The drive pin 39 is fixed on a drive link 47 which pivots in a groove 49 in carrier body 31. The other end of the drive link 47 is pivotally connected by a pin 51 to a pole arm 53 on a pole shaft 55 similarly connected to carriers in the other poles of the circuit breaker. The pole shaft 55 is rotated by an operating mechanism shown schematically at 57 mounted on the front of the front casing 5 and enclosed by a cover (not shown).

A moving main contact 21 is fixed to each of the contact fingers 25 at a point spaced from the free end of the finger. The portion of the contact finger 25 adjacent the free end forms a moving arcing contact or "arc toe" 59. The stationary arcing contact 61 which together with the arc toe 59 forms a pair of arcing contacts 63 and is provided by the integral arcing contact and runner 65.

Figure 4:
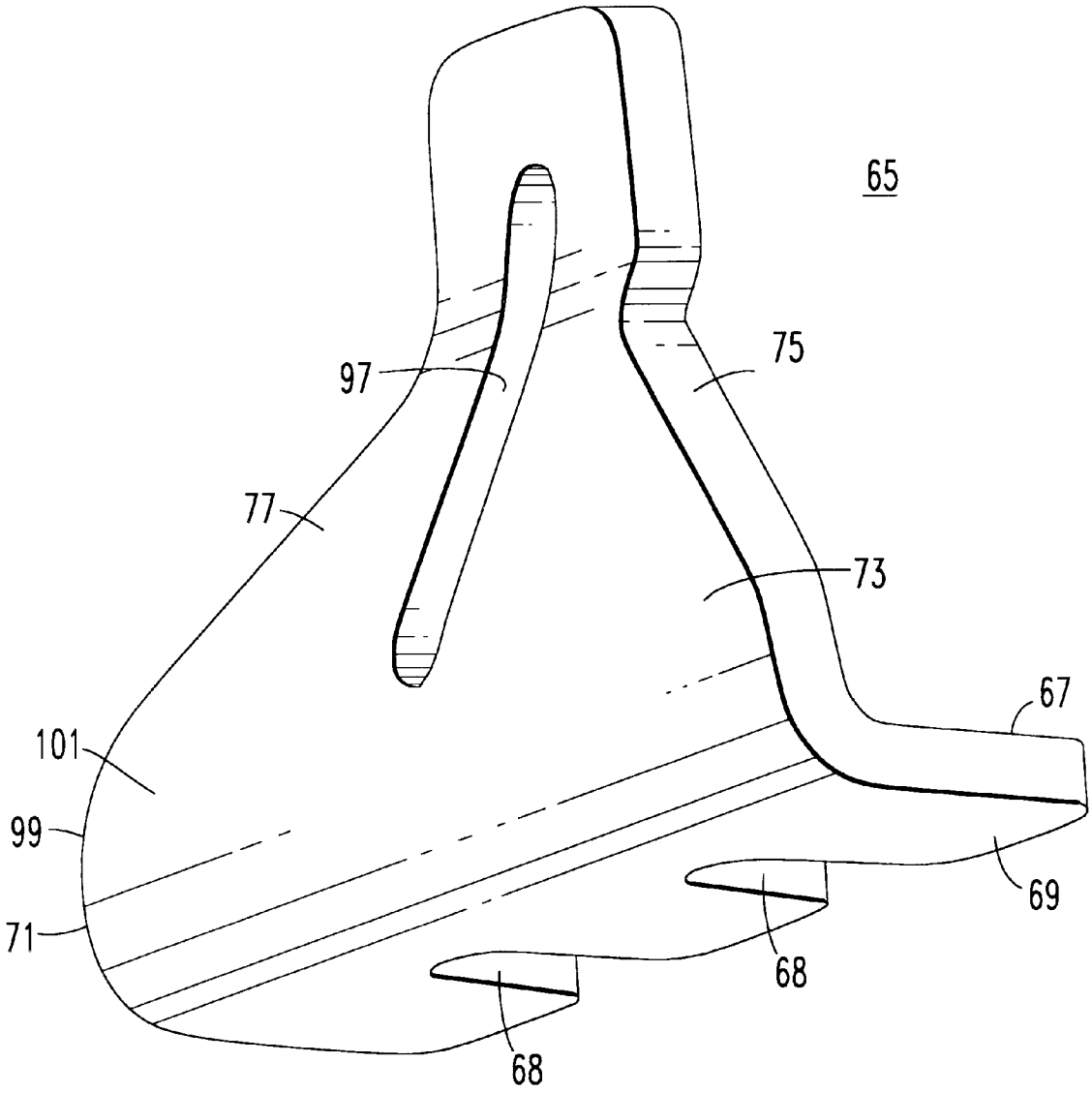
FIG. 4 is an isometric view of the integral arcing contact and runner of FIG. 1.

As best seen in FIG. 4, this integral arcing contact and runner 65 is an electrically conductive member having a base section 67 with a base surface 69, an arcing contact section 71 having an arcing contact surface 73, and a runner section 75 having a runner surface 77. In the preferred embodiment, the integral arcing contact and runner 65 is a sheet metal member made of copper or steel plated with nickel, copper or other suitable material. The integral arcing contact and runner 65 is mounted on the line conductor by a bolt 79 which extends through a support block 81, the base section 67, the line conductor 13 and is secured by a nut 80 seated in a slot 82 in the housing, as shown for instance in FIG. 2. The arcing contact surface 73 of the integral arcing contact and runner 65 is parallel to the stationary main contact 19 but extends laterally farther toward the movable arcing contact or arc toe 59 for a purpose to be discussed. The runner section 75 forms an obtuse angle $\alpha$ with the arcing contact section 71 and leads upward and outward toward one side of an arc chute 83. Thus, the sheet metal member 65 is bent by an angle $\beta$ of less than 90° in forming the arcing contact section 71 and the runner section 75. Arc chutes such as 83 are known and include a plurality of arc plates 85 held in spaced relation by a pair of arc side plates 87 (only one shown). At the other side of the arc chute 83 is a top arc plate 89 which extends downward and points toward the moving arcing contact 59, again for a purpose to be described.

The contact fingers 25 are biased clockwise by pairs of helical compression springs 91 seated in recesses 93 in the carrier body 31. The operating mechanism 57 rotates the pole shaft 55 which in turn pivots the contact carrier 29 between open and closed positions to open and close the contacts. In the open position shown in FIG. 3, the contact carrier is rotated counterclockwise so that the separable main contacts 17 and arcing contacts 63 are fully opened. As the carrier 29 is rotated clockwise toward a closed position, the arc toes 59 contact the arcing contact surface 73 first as shown in FIG. 2. As the carrier 29 continues to move clockwise, the springs 91 compress as the contact fingers 25 rock about the pivot pin 27 until the main contacts 17 close. Further clockwise rotation to the fully closed position shown in FIG. 1 results in opening of the arcing contacts 63 while the main contacts 17 remain closed. In that closed position a circuit is completed from the line conductor 13 through the closed main contacts 17, the contact fingers 25, flexible shunts 95 and the load conductor 15 (see FIG. 2). To open the circuit breaker, the operating mechanism 57 releases the pole shaft 55 so that the compressed springs 91 accelerate the carrier 29 counterclockwise as viewed in FIG. 1. Initially, as the carrier moves away from the line conductor, the contact fingers 29 rock so that the arcing contacts 63 close while the main contacts remain closed (not shown). As the carrier 29 continues to move counterclockwise, the main contacts open as shown in FIG. 2 and all of the current is transferred to the arcing contacts 63. If current is being carried by the circuit breaker such as when the circuit breaker trips open in response to an overcurrent or short circuit, an arc is struck between the stationary arcing contact 61 and the movable arcing contact or arc toe 59 as these contacts separate with continued counterclockwise rotation of the carrier. As the main contacts 17 have already separated, the arcing is confined to the arcing contacts 63 which preserves the life of the main contacts. The electromagnetic forces produced by the current sustained in the arc push the arc outward toward the arc chute 83 so that the end of the arc at the stationary arcing contact 61 moves up the arcing contact section 71 of the integral arcing contact and runner 65 onto the runner section 75. At the same time, the rapid opening of the carrier brings the arc toes 59 adjacent the free end of the arc top plate 89 as shown in FIG. 3 so that the arc extends from the arc toe 59 to the arc top plate and moves up the arc top plate into the arc plates 85 which breaks the arc up into shorter sections. As is known, this stretching of the arc and breaking it up into smaller sections increases the arc voltage. The increase in arc voltage, together with the cooling of the arc by ablation of the arc plates 85 promotes interruption of the arc.

The integral stationary arcing contact and runner 65 eliminates the joint that was present between the prior art arc block forming the stationary arcing contact and the separate arc runner. This makes it easier for the arc to move from the stationary arcing contact 61 to the runner section 75 where it then is directed upward toward the arc chute by the edge created by the slot 97, which in the exemplary configuration is a closed slot. Also, since the arcing contact section 71 is a flat section transverse to the base section 67, the bend to the runner section is not as sharp as in the prior art separate arc runner which had a base section similar to the base section 67 which was then bent more than 90° to the runner section. The integral stationary arc contact and runner 65 also has an arcuate section 99 between the arcing contact section 71 and the runner section 75 which provides an arcuate surface 101 without any sharp lateral edges which could divert the arc to the sides or cause hesitation in movement of the arc toward the arc chute.

The carrier 29 has a feature which concentrates the arc near the center of the stationary arcing contact 61 and therefore helps to direct the arc toward the center slot 97. As can be seen from FIG. 2 the tail ends 103 of the contact fingers 25 are biased by the springs 91 against a stop ledge 105 on the carrier body 31. The center of this stop ledge 105 has a recess 107 (see FIG. 1) which allows the center contact fingers 25 to rotate farther clockwise when the carrier is not in the closed position than the outer contact fingers (see FIG. 3). Therefore, the arcing contacts 59 on the center contact fingers 25 are the first to contact during closing. More importantly, they are the last to separate on opening so that the arc is struck only between the arcing contacts at the center.

The movable arcing contacts 59 strike the stationary arcing contacts 61 with a very large force during closing of the circuit breaker. The support block 81 transmits the reaction forces from the sheet metal integral arcing contact and runner 65 into the housing 3 to prevent distortion or bending of this sheet metal member. Instead of being a separate item, the support block could be integrally molded with the rear casing 7 of the housing 3.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of invention which is to be given the full breath of the claims appended and any and all equivalents thereof.

What is claimed is:

1. Electrical switching apparatus comprising:

a housing;

a load conductor and a line conductor mounted in said housing;

a pair of main contacts including a movable main contact and a stationary main contact, and a separable pair of arcing contacts, including a movable arcing contact and a stationary arcing contact, said stationary main contact and stationary arcing contact being in electrical contact with said line conductor;

a moving conductor assembly connecting said movable main contact and said movable arcing contact to said load conductor and comprising a contact carrier mounted for movement between an open position and a closed position to open and close said separable pairs of contacts, at least one contact finger pivotally mounted on said contact carrier and having said moving arcing contact adjacent a free end and said moving main contact spaced from said free end, and contact spring means pivotally biasing said at least one contact finger to rock from closure only of said pair of main contacts with said carrier in said closed position, to closure of both said pair of main contacts and said separable pair of arcing contacts, to closure of only said separable pair of arcing contacts while said pair of main contacts are opened, to opening of said separable pair of arcing contacts as said carrier moves to said open position;

an arc chute positioned adjacent said moving conductor assembly; and an arc runner integral with said stationary arcing contact and extending toward said arc chute to provide a path without joints for an arc struck between said separable pair of arcing contacts as said separable pair of arcing contacts open with movement of said moving conductor assembly from the closed position.

2. The electrical switching apparatus of claim 1 wherein said stationary arcing contact and integral arc runner comprise an electrically conductive member having a base surface in contact with said load conductor, a stationary arcing contact surface forming said stationary arcing contact, and a runner surface leading toward said arc chute.

3. The electrical switching apparatus of claim 2 wherein said arcing contact surface of said electrically conductive member is substantially transverse to said base surface and at an obtuse angle to said runner surface.

4. The electrical switching apparatus of claim 3 wherein said electrically conductive member further has an arcuate surface between said arcing contact surface and said runner surface.

5. Electrical switching apparatus comprising:

a housing;

a load conductor and a line conductor mounted in said housing;

a pair of main contacts including a movable main contact and a stationary main contact, and a separable pair of arcing contacts, including a movable arcing contact and a stationary arcing contact, said stationary main contact and stationary arcing contact being in electrical contact with said line conductor;

a moving conductor assembly connecting said movable main contact and said movable arcing contact to said load conductor and comprising a contact carrier mounted for movement between an open position and a closed position to open and close said separable pairs of contacts, at least one contact finger pivotally mounted on said contact carrier and having said moving arcing contact adjacent a free end and said moving main contact spaced from said free end, and contact spring means pivotally biasing said at least one contact finger to rock from closure only of said pair of main contacts with said carrier in said closed position, to closure of both said pair of main contacts and said separable pair of arcing contacts, to closure of only said separable pair of arcing contacts while said pair of main contacts are opened, to opening of said separable pair of arcing contacts as said carrier moves to said open position;

an arc chute positioned adjacent said moving conductor assembly;

an arc runner integral with said stationary arcing contact and extending toward said arc chute to provide a path without joints for an arc struck between said separable pair of arcing contacts as said separable pair of arcing contacts open with movement of said moving conductor assembly from the closed position;

wherein said stationary arcing contact and integral arc runner comprise an electrically conductive member having a base surface in contact with said load conductor, a stationary arcing contact surface forming said stationary arcing contact, and a runner surface leading toward said arc chute; and wherein said electrically conductive member is a sheet metal member having a base section with said base surface, a stationary arcing contact section with said stationary arcing contact surface, and a runner section with said runner surface.

6. The electrical switching apparatus of claim 5 wherein said runner section has a longitudinal slot generally laterally centered.

7. The electrical switching apparatus of claim 5 wherein said sheet metal member includes an arcuate section with an arcuate surface between said arcing contact section and said runner section.

8. The electrical switching apparatus of claim 7 wherein said movable arcing contact comprises and arc toe on said at least one contact finger.

9. The electrical switching apparatus of claim 5 wherein said arcing contact surface of said electrically conductive member is substantially transverse to said base surface and at an obtuse angle to said runner surface.

10. The electrical switching apparatus of claim 9 including a support member between said arcing contact section and said housing.

11. The electrical switching apparatus of claim 10 including fastener means extending through said support member, said base section, and said line conductor and secured to said housing.

12. The electrical switching apparatus of claim 11 wherein said sheet metal member includes an arcuate section with an arcuate surface between said arcing contact section and said runner section.

13. The electrical switching apparatus of claim 1 wherein said movable arcing contact comprises an arc toe on said at least one contact finger.

* * * * *